US008012266B2

(12) United States Patent
Janzen et al.

(10) Patent No.: US 8,012,266 B2
(45) Date of Patent: Sep. 6, 2011

(54) SYSTEM AND METHOD FOR SCRUBBING CMP SLURRY SYSTEMS

(75) Inventors: John W. Janzen, Andover, MN (US); Daniel K. Casey, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 556 days.

(21) Appl. No.: 11/639,884

(22) Filed: Dec. 15, 2006

(65) Prior Publication Data

US 2008/0142040 A1 Jun. 19, 2008

(51) Int. Cl.
*B08B 9/032* (2006.01)

(52) U.S. Cl. ..... 134/22.12; 134/34; 134/36

(58) Field of Classification Search ..... None
See application file for complete search history.

(56) References Cited

U.S. PATENT DOCUMENTS

| | | | | |
|---|---|---|---|---|
| 3,695,281 | A * | 10/1972 | Leon | 137/1 |
| 4,053,282 | A * | 10/1977 | Hach et al. | 436/53 |
| 4,898,197 | A | 2/1990 | Barry et al. | |
| 5,593,339 | A | 1/1997 | Yam et al. | |
| 5,849,091 | A | 12/1998 | Skrovan et al. | |
| 5,941,257 | A * | 8/1999 | Gruszczynski, II | 134/22.11 |
| 6,028,006 | A * | 2/2000 | Bawa et al. | 438/692 |
| 6,656,366 | B1 | 12/2003 | Fung et al. | |
| 6,722,422 | B1 * | 4/2004 | Feldmeier | 165/154 |
| 2004/0241046 | A1 * | 12/2004 | Bates et al. | 422/80 |

FOREIGN PATENT DOCUMENTS

| | | | |
|---|---|---|---|
| DE | 102 04 737 | A1 | 8/2003 |
| EP | 0 490 117 | A | 6/1992 |
| EP | 0 767 010 | A | 4/1997 |
| GB | 2 140 121 | A | 11/1984 |

OTHER PUBLICATIONS

International Search Report for EP07122690, claiming priority to U.S. Appl. No. 11/639,884.

* cited by examiner

*Primary Examiner* — Michael Kornakov
*Assistant Examiner* — Ryan Coleman
(74) *Attorney, Agent, or Firm* — Shumaker & Sieffert, P.A.

(57) ABSTRACT

A system and apparatus for cleaning particle deposits from slurry distribution system components by injecting gas bubbles into the slurry solution having a geometry and interval such that an optimal cleaning power and cleaning rate is obtained. The method provides efficient cleaning of the buildup of abrasive particles deposited from the slurry solution without requiring the operator to disassemble or flush the slurry distribution system. The system cleaning potential is optimal when the diameter of the bubbles and the fluid slug length is approximately equal to the pipe diameter.

9 Claims, 3 Drawing Sheets

SYSTEM AND METHOD FOR SCRUBBING CMP SLURRY SYSTEMS

FIELD OF THE INVENTION

The present invention relates to a method for scrubbing surfaces of a chemical mechanical polishing system used in the manufacture of integrated circuits. More particularly, the invention pertains to removing deposits of the abrasive component of aqueous slurry solutions used by CMP systems

BACKGROUND OF THE INVENTION

Chemical Mechanical Polishing (CMP) systems are widely used in the integrated circuit manufacturing industry to produce very smooth surfaces upon which integrated circuits may be assembled. The CMP systems typically use an aqueous slurry solution containing a chemical corrosive together with abrasive particles that accelerate the effectiveness of the chemical corrosive. The abrasive particles can contaminate slurry distribution systems by agglomerating into larger particles and clogging the plumbing of the slurry distribution system, and by building up on the surfaces of the plumbing or the tank of the slurry distribution system. This not only impedes the desired circulation of the slurry solution, but also creates fluctuations in the concentration and size of the abrasive particles in the slurry solution, causing manufacturing problems such as scratching of the wafer surfaces or deposits of the abrasive particles on the wafer surfaces being polished. Therefore, these systems must be frequently cleaned to rid the systems of buildup of these abrasive particles.

The cleaning processes currently utilized typically create significant inefficiencies. Some cleaning methods require that the entire system be drained and filled with a cleaning solution designed to rid the system of deposits of the abrasive particles. The operator must first stop production, drain the system of the slurry solution, and run the cleaning solution through the slurry distribution system until the particulate buildup has been sufficiently removed. It is important to maintain the pH of the aqueous slurry solution and the concentration of abrasive particles within a very small range in order to minimize scratches and deposits of abrasive particles on the wafer surfaces. Therefore, because the cleaning solutions frequently contain chemicals which are not typically present in the slurry solution, the system must then be thoroughly flushed in order to rid the system of any chemicals which might cause fluctuations in the composition of the slurry solution. These systems for cleaning the slurry distribution system are not desirable because they create considerable downtime and consume large amounts of chemicals which may be expensive and difficult to properly dispose.

Other cleaning methods require disassembly of the slurry distribution system in order to individually clean the plumbing components of deposits of the abrasive particles. The user must stop production, completely drain the system of the slurry solution, and disassemble the plumbing of the slurry distribution system. The plumbing components must then be individually cleaned of the particle buildup, reassembled, and the system re-filled with the slurry solution before production may resume. This system is also not desirable in that it requires significant downtime.

Accordingly, there is a need for more efficient methods of cleaning CMP slurry distribution systems.

SUMMARY OF THE INVENTION

A system and apparatus for cleaning particle deposits from slurry distribution system components in accordance with the present invention includes injecting gas bubbles into the slurry solution to increase the cleaning power of the fluid in the slurry solution. The system cleaning potential is optimal when the diameter of the bubbles and the fluid slug length is approximately equal to the pipe diameter. The method provides efficient cleaning of the buildup of abrasive particles deposited from the slurry solution without requiring the operator to disassemble or flush the slurry distribution system.

DETAILED DESCRIPTION

A method and apparatus for cleaning a slurry distribution system is provided that, in various embodiments, injects gas bubbles into a slurry distribution system to clean the system of abrasive particles deposited on the system components by the slurry solution. The method and apparatus for cleaning a slurry distribution system is described with reference to FIGS. 1-5.

Figure 1:
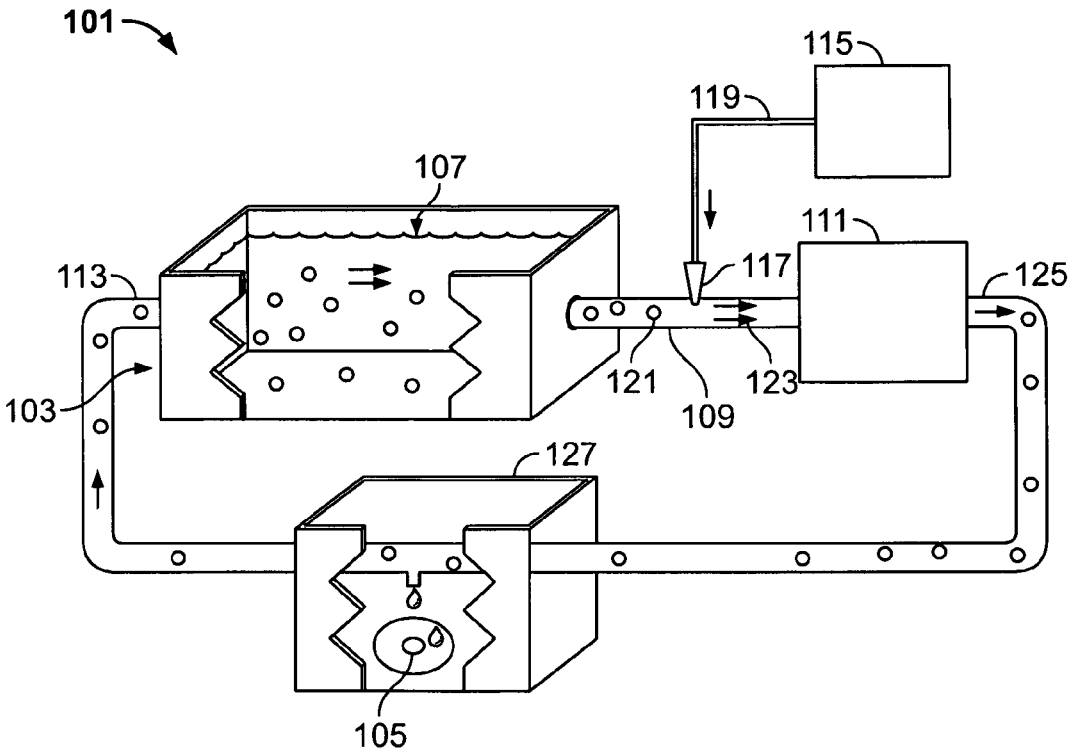
FIG. 1 is a schematic drawing of a system for cleaning a slurry distribution system via gas injection in accordance with the present invention.

As shown in FIG. 1, a gas injection device 117 may be used with a slurry distribution system 101 to inject gas bubbles 121 into a liquid flowing through the slurry distribution system 101. These bubbles act as scrubbers, carrying away deposits of abrasive particles which build up on the surfaces of the slurry distribution system 101. The slurry distribution system 101 includes a tank 103 which holds the slurry solution 107. The tank 103 may have a slurry solution input 109 and a slurry solution return 113 for the circulation of the slurry solution 107 through the tank 103. The slurry solution input 109 and the slurry solution return 113 are shown as pipes horizontally configured along the liquid flow direction 123. However, the slurry solution input 109 and the slurry solution return 113 may be configured in any way suitable to circulate the slurry solution 107 through the slurry distribution system 101.

The flow of the slurry solution 107 is controlled by the apparatus controller 111. The apparatus controller 111 receives the slurry solution from the slurry solution input 109. The apparatus controller 111 regulates the system pressure of the slurry distribution system 101 and the flow velocity of the slurry solution 107, as well as other parameters necessary for the production of the wafers 105, such as the concentration of chemical components of the slurry solution 107, the concentration of abrasive particles in the slurry solution 107, and the temperature and pH of the slurry solution 107. The apparatus controller 111 is shown in FIG. 1 as having only a slurry solution supply 125 and slurry solution input 109. However, any configuration may be used in which apparatus controller 111 is able to properly control the system parameters.

The purpose of the slurry distribution system 101 is to polish the surfaces of wafers 105 produced for use in the integrated circuit industry. The slurry solution 107 is dispensed into the CMP machine 127 to polish the wafers 105. The polishing is accomplished by the scrubbing action of abrasive particles present in the slurry solution 107 in combination with the chemical action of the slurry solution 107. The gas bubbles 121 may be injected in a continuous mode into the slurry distribution system 101 at a very low rate to provide continuous removal of particle deposits. Alternatively, the slurry distribution system 101 may be placed in a cleaning mode, in which the wafers 105 would be removed from the slurry distribution system. In this mode, the gas bubbles 121 may be injected at a higher rate and larger bubble diameter in order to obtain an optimal cleaning power and cleaning rate. In this mode, the wafers 105 are removed because of possible damage which may be caused from the higher concentration of abrasive particles in the slurry solution 107 due to the cleaning action of the gas bubbles 121.

A gas injection controller 115 contains a gas injection feed line 119 and the gas injection device 117. The gas injection controller 115 is capable of controlling the amount of gas injected into the slurry distribution system 101 so as to obtain gas bubbles 121 of uniform size. In a preferred embodiment, the gas injection controller 115 is capable of varying the amount of gas injected into the slurry distribution system 101 so as to produce gas bubbles 121 with a specified diameter determined by the geometry of the slurry distribution system 101. The gas injection controller 115 is also capable of controlling the time interval between the injections of the gas bubbles 121 so as to obtain a uniform distance between the gas bubbles 121. The gas injection controller 115 emits gas through the gas injection feed line 119 to the gas injection device 117. The gas injection device 117 may be a nozzle or any other device capable of injecting pressurized gas into the slurry distribution system 101. In FIG. 1, the gas injection device 117 is shown located in the slurry solution input 109. However, the gas injection device 117 may be located at any convenient location or in multiple locations in the slurry distribution system 101.

Figure 2:
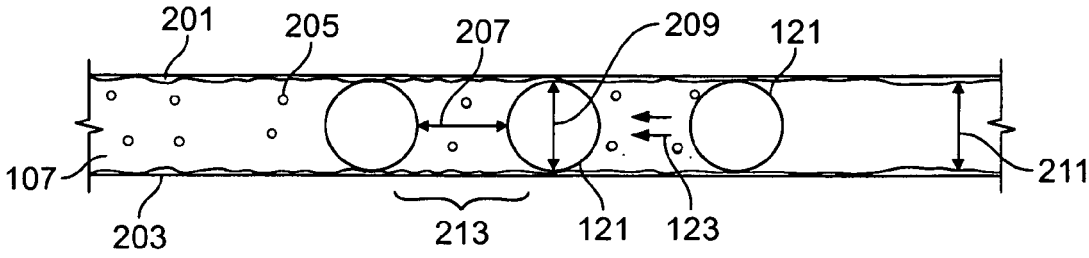
FIG. 2 is a detailed view of a portion of the slurry distribution system of FIG. 1.

FIG. 2 illustrates a preferred embodiment of the present invention. The efficacy of the cleaning action performed by the gas bubbles 121 is governed by the geometry of the gas bubbles 121 and the amount of fluid between the gas bubbles 121. The volume of fluid between the gas bubbles 121 is known as a fluid slug 213. The action of the fluid slugs 213 and the gas bubbles 121 passing over the particle deposits 201 creates a physical shock wave which dislodges the particle deposits 201, resulting in improved removal of particle buildup. Various gases may be used in combination with the slurry solution 107 to produce the desired removal of particle deposits 201. It is desirable to choose a gas that is inert, has low solubility in the fluid medium and is easily removed by an excess gas removal system. Examples of such gases are air, argon, nitrogen and helium.

For a slurry distribution system 101 in which the slurry solution 107 flow rate is held constant, the power of the cleaning action of the gas bubbles 121 is proportional to the bubble diameter 209. A threshold exists where the bubble diameter 209 is equal to the pipe diameter 211. Below this threshold, the power of the cleaning action of the gas bubble 121 decreases as the bubble diameter 209 decreases. Above this threshold, where the bubble diameter 209 is greater than the pipe diameter 211, the cleaning power remains relatively constant. The maximum cleaning efficiency is obtained when the bubble diameter 209 is approximately equal to the pipe diameter 211.

For a slurry distribution system 101 in which the slurry solution flow rate is held constant, the rate of the cleaning action of the gas bubbles 121 is proportional to the rate that the gas bubbles 121 and fluid slugs 213 pass over the particle deposits 201. The optimal cleaning rate is reached when the length of the fluid slug 213 at the radius of the pipe is approximately equal to the pipe diameter 211. Additionally, when the slurry distribution system 101 is in cleaning mode, the fluid flow rate may be increased to obtain a higher cleaning rate.

The gas injection controller 115 should vary the amount of gas injected and rate of gas bubbles 121 injected in order to obtain the optimal conditions where the pipe diameter 211 of at least one component of the slurry distribution system 101 is approximately equal to the bubble diameter 209 and the fluid slug length 207. For instance, a bubble diameter 209 and fluid slug length 207 within 20% of the pipe diameter 211 will produce cleaning conditions acceptably close to optimal cleaning conditions.

Because the slurry distribution system 101 may contain system components of different diameters, the gas injection controller 115 may not be able to produce gas bubbles 121 having optimal bubble diameter 209 and fluid slug length 207 for all components of the slurry distribution system 101 simultaneously. Therefore, a single set of optimal parameters for bubble diameter 209 and fluid slug length 207 may not produce ideal cleaning conditions for the entire slurry distribution system 101. This may be dealt with by various methods.

Figure 3:
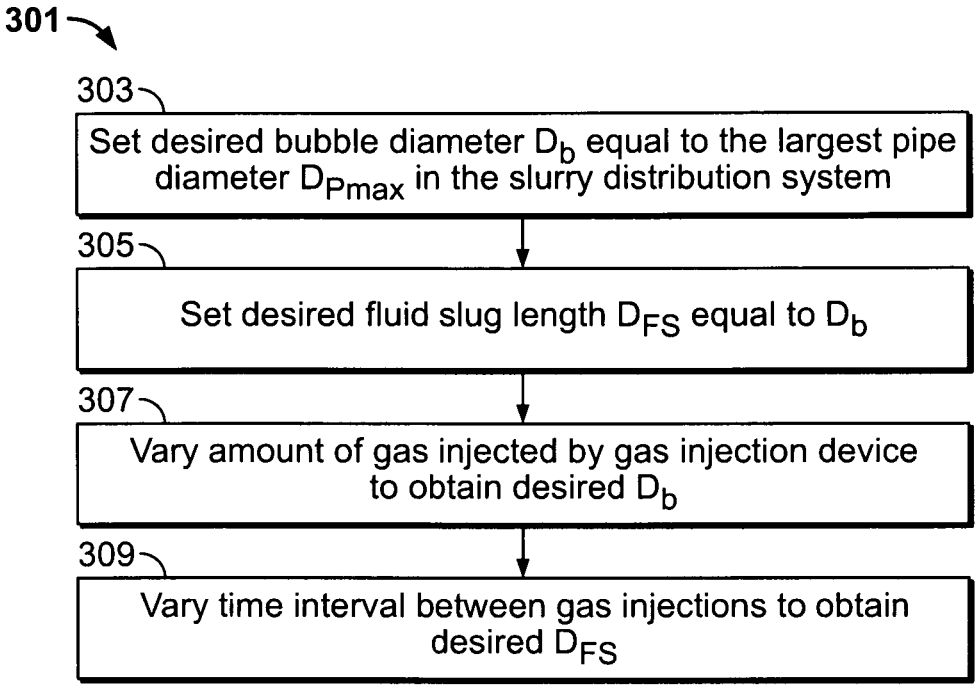
FIG. 3 is a flow chart illustrating the steps associated with varying the amount and time interval of the gas injection to control bubble diameter and flow rate.
Figure 4:
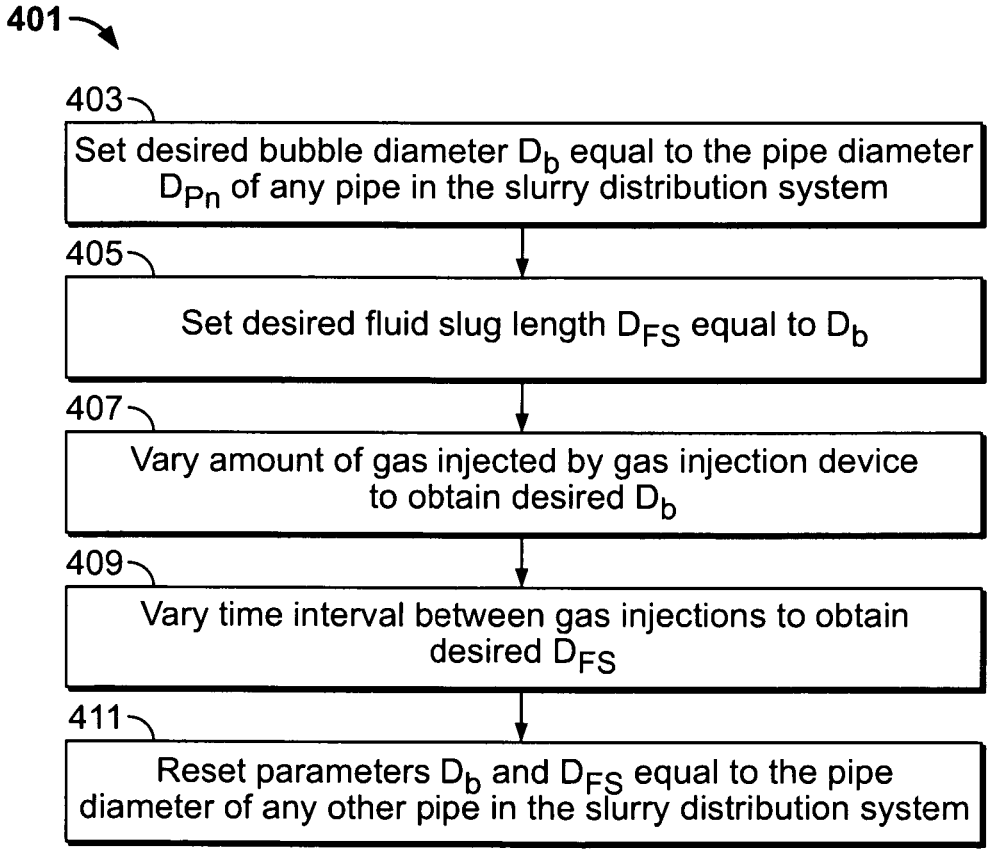
FIG. 4 is a flow chart illustrating the steps associated with varying the amount and time interval of the gas injection in order to obtain an ideal bubble diameter and flow rate for a plurality of pipe diameters in the slurry distribution system.
Figure 5:
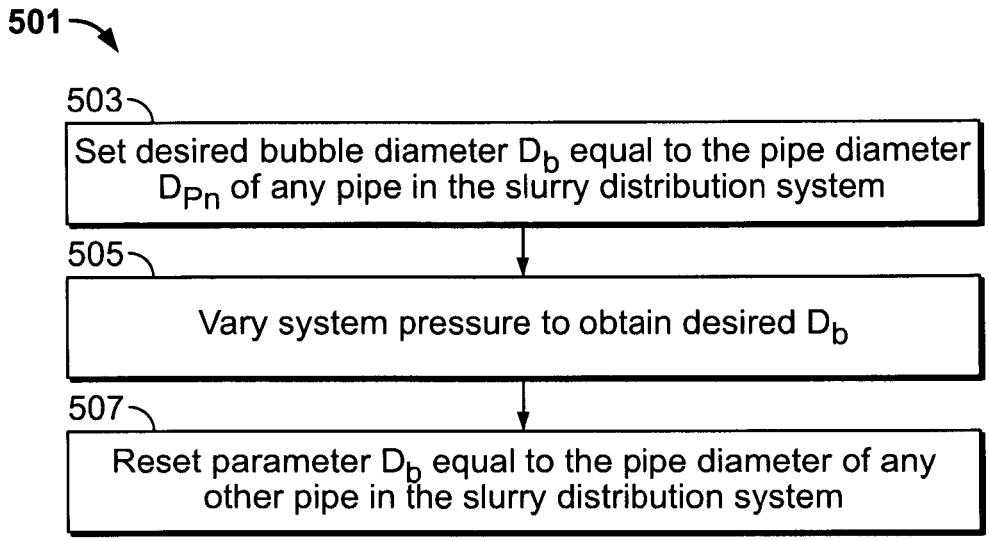
FIG. 5 is a flow chart illustrating the steps associated with varying the system pressure in order to obtain an ideal bubble diameter and flow rate for a plurality of pipe diameters in the slurry distribution system.

Several illustrations of variations of gas bubble size, the interval between the gas bubbles, and the variation of system pressure in order to optimize cleaning conditions are described with references to FIGS. 1-5, and primarily FIGS. 3-5.

FIG. 3 illustrates a first method 301 for controlling bubble diameter 209 and fluid slug length 207 to obtain optimal cleaning conditions for the largest pipe diameter of the slurry distribution system 101. In this first method 301, the gas injection controller 115 may set the desired bubble diameter and desired fluid slug length equal to the system component having the largest diameter as represented in blocks 303 and 305. The gas injection controller 115 may then vary the amount of gas injected by the gas injection device 117, as shown in block 307, and the time interval between the gas injections, as shown in block 309, to obtain the desired bubble diameter. In this embodiment, optimal conditions are obtained for the system component having the largest pipe diameter. For system components having smaller pipe diameters, optimal conditions are not obtained. The cleaning rate will decrease because the bubble diameter 209 is larger than the pipe diameter 211. However, because near-optimal cleaning power is maintained when the bubble diameter 209 is greater than the pipe diameter 211, the cleaning power will remain relatively constant throughout the system. This is believed to be the most advantageous arrangement for a system in which it is desirable to have only one set of parameters for the bubble diameter 209 and fluid slug length 207, such as, for instance, systems in which the gas injection controller 115 does not provide the capability of easily or automatically changing the system parameter setpoints.

FIG. 4 illustrates a second method 401 for using a programmable gas injection controller 115 to vary the parameters for the desired bubble diameter and fluid slug length to obtain optimal cleaning conditions for a plurality of pipe diameters of the slurry distribution system 101. In this second method 401, the gas injection controller 115 may set the desired bubble diameter and desired fluid slug length equal to the pipe diameter of any pipe in the slurry distribution system 101 as represented in blocks 403 and 405. The gas injection controller 115 then injects gas bubbles 121 into the slurry distribution system 101 having geometries optimal for one pipe diameter for a determined amount of time as shown in blocks 407 and 409. After this time period, the gas injection controller 115 changes the system parameters to correspond to another pipe diameter for a determined amount of time as shown in block 411. In this way, the gas injection controller obtains optimal system parameters in a plurality of pipe diameters in the slurry distribution system 101. This second method 401 may be repeated for each pipe diameter in the slurry distribution system 101, giving optimal cleaning conditions for a plurality of pipes in the slurry distribution system 101.

FIG. 5 illustrates a third method 501 for using the apparatus controller 111 to vary the system pressure of the slurry distribution system 101 to obtain optimal cleaning conditions in a plurality of pipes in the slurry distribution system 101. In this third method 501, the apparatus controller 111 may set the desired bubble diameter equal to the diameter of a pipe in the slurry distribution system 101, as shown in block 503. The apparatus controller 111 may then vary the system pressure to obtain gas bubbles having the desired diameter as shown in block 505. In another embodiment, the apparatus controller 111 may periodically vary the system parameters to obtain optimal gas bubble diameters for a plurality of pipes in the slurry distribution system 101 as shown in block 507. By varying the system pressure to obtain the new desired bubble diameter, the system may obtain optimal cleaning conditions for a plurality of pipes in the slurry distribution system 101.

Figure 6:
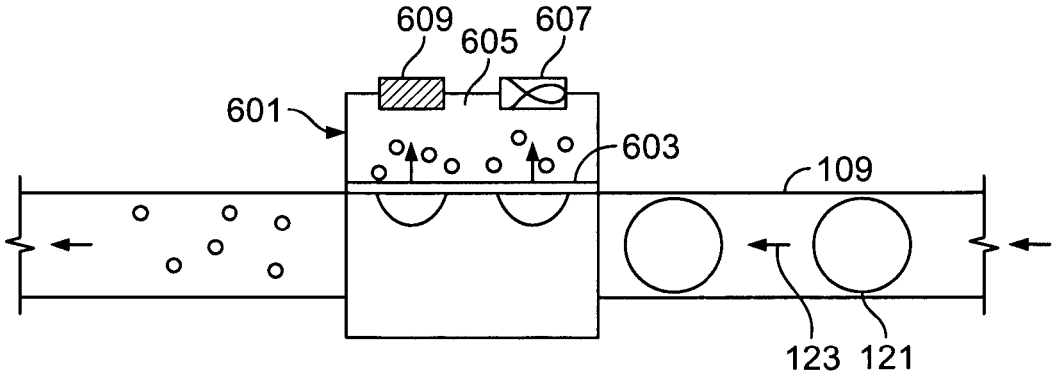
FIG. 6 is a schematic drawing of a system for removing unwanted bubbles from the slurry distribution system using a membrane having the slurry cleaning solution on one side and a low pressure area on the other.
Figure 7:
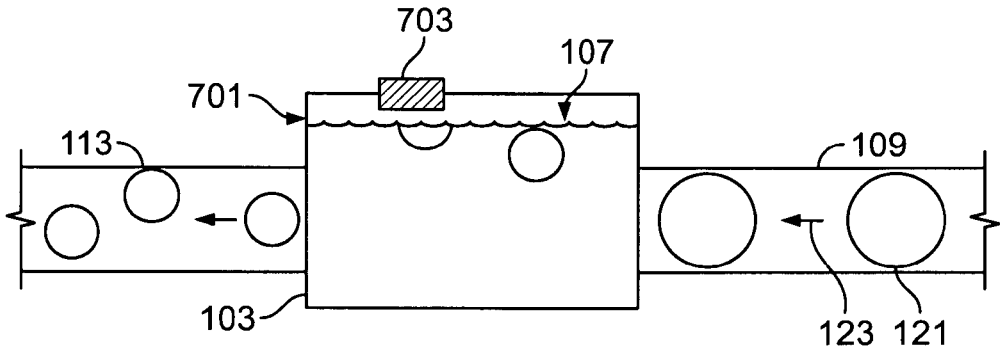
FIG. 7 is a schematic drawing of a system for removing unwanted bubbles from the slurry distribution system using a gas collection chamber and venting apparatus.

A system for removing unwanted or excess bubbles may be necessary. The methods of the present invention for removing unwanted or excess bubbles from a slurry distribution system 101 are described with reference to FIGS. 1-7, and primarily FIGS. 6 and 7. In one embodiment, the excess bubbles may be removed from the slurry distribution system 101 through the use of a membrane 603. The membrane 603 is exposed to the slurry solution 107 on one side. On the opposite side, a low pressure area 605 acts to draw the bubbles out of the slurry solution 107. The membrane gas removal apparatus 601 is capable of maintaining the low pressure area 605 at the desired pressure. The low pressure may be maintained through the use of a simple fan 607 and venting apparatus 609. However, other methods may be used to maintain the low pressure area 605.

In another embodiment, a gas collection chamber 701 may be used to remove unwanted gas from the slurry distribution system 101. In the slurry distribution system 101, a gas collection chamber would collect the gas bubbles 121 as they rise to the surface of the slurry solution 107 because of the lower density of the gas bubbles 121 relative to the slurry solution 107. The gas collection chamber 701 collects these gas bubbles 121, which may be vented away by automatic or manual activation of the venting apparatus 703.

It should be understood that the illustrated embodiments are examples only and should not be taken as limiting the scope of the present invention. The claims should not be read as limited to the described order or elements unless stated to that effect. Therefore, all embodiments that come within the scope and spirit of the following claims and equivalents thereto are claimed as the invention.

We claim:

1. A method for cleaning a fluid distribution system containing a fluid, comprising:

injecting gas bubbles into the fluid of the fluid distribution system, the gas bubbles having a diameter substantially equal to a fluid slug length between the gas bubbles; and passing the fluid containing the gas bubbles over a surface of the fluid distribution system such that a physical shock associated with the bubbles and fluid passing over particle deposits on the surface of the fluid distribution system dislodges the particle deposits, wherein the gas bubble diameter and the fluid slug length are varied periodically to obtain a bubble diameter and fluid slug length substantially equal to one of a plurality of pipe diameters in the fluid distribution system.

2. The method of claim 1, wherein the gas bubbles injected into the fluid of the fluid distribution system have a diameter substantially equal to a largest pipe diameter of the fluid distribution system.

3. The method of claim 1, wherein a pressure of the fluid distribution system is periodically changed to produce gas bubble diameters substantially equal to a pipe diameter of a plurality of pipes in the fluid distribution system.

4. The method of claim 1, wherein the gas bubbles are injected into the fluid distribution system in a plurality of locations, wherein the gas bubbles injected into the fluid distribution system have a diameter substantially equal to a diameter of a pipe at the location at which the gas bubbles are injected, and wherein a time interval between injections of the gas bubbles produces a fluid slug between the gas bubbles having a length substantially equal to the diameter of the gas bubbles.

5. The method of claim 1, wherein excess gas bubbles are removed from the fluid distribution system by inserting a first side of a membrane in contact with the fluid containing the gas bubbles, the membrane having a porosity such that the gas bubbles may be transmitted through the membrane, and by maintaining an area of low pressure relative to the fluid on a second side of the membrane.

6. The method of claim 1, wherein excess gas bubbles are removed from the fluid distribution system by inserting a gas collection chamber over a tank or the fluid distribution system.

7. The method of claim 1, wherein the fluid distribution system comprises a slurry distribution system.

8. The method of claim 1, wherein the particle deposits comprise abrasive particle deposits.

9. The method of claim 1, wherein the fluid distribution system comprises a slurry distribution system, and wherein the particle deposits comprise abrasive particle deposits.

* * * * *